United States Patent [19]

Kelly et al.

[11] 4,208,457

[45] Jun. 17, 1980

[54] PLASTIC NETTING FOR LOAD UNITIZATION

[75] Inventors: Michael G. Kelly, Blaine; Eugene R. Pastien, Moundsview, both of Minn.

[73] Assignee: Conwed Corporation, St. Paul, Minn.

[21] Appl. No.: 35,851

[22] Filed: May 4, 1979

[51] Int. Cl.[2] ..... B32B 5/12

[52] U.S. Cl. ..... 428/107; 428/108; 428/255; 428/910

[58] Field of Search ..... 428/68, 105, 102, 108, 428/112, 131, 137, 255, 910; 156/166, 167, 180, 181; 53/461, 559; 206/386

[56] References Cited

U.S. PATENT DOCUMENTS

| | | | |
|---|---|---|---|
| 2,919,467 | 1/1960 | Mercer | 428/255 |
| 3,073,002 | 1/1963 | Munt | 428/910 |
| 3,186,893 | 6/1965 | Mercer | 428/255 |
| 3,260,776 | 7/1966 | Lindstrom | 428/910 |
| 3,386,876 | 6/1968 | Wyckoff | 428/255 |
| 3,405,027 | 10/1968 | Wyckoff | 428/255 |
| 3,744,529 | 7/1973 | Jorda et al. | 428/107 |
| 3,867,242 | 2/1975 | Miller | 428/107 |
| 4,136,501 | 1/1979 | Connolly | 428/107 |

*Primary Examiner*—James J. Bell

*Attorney, Agent, or Firm*—Eyre, Mann, Lucas & Just

[57] ABSTRACT

An improved wrapping material for palletized loads is disclosed. A plastic net material which has been biaxially oriented to have a stretch factor of less than 15% under specified conditions is used for wrapping about the palletized load.

3 Claims, No Drawings

PLASTIC NETTING FOR LOAD UNITIZATION

The present invention relates to packaging materials and in particular to an improved product for the wrapping of palletized loads.

The use of plastic nets for the wrapping of palletized loads is well known in the art. This is disclosed, for example, in U.S. Pat. Nos. 4,136,501 and 3,945,493. The former patent teaches that the net should be stretched while it is being applied while the latter teaches that the net should be heat shrunk about the load. Each of these has substantial disadvantages from a commercial point of view.

With the stretchable netting, it is most important that the degree of stretching be carefully controlled as the netting is wrapped around the load. In addition, since the material being applied is stretched as it is applied, it is also capable of being stretched after it is on the load. This has been found to be a substantial disadvantage, especially with relatively heavy loads moving over relatively rough roads.

With the heat shrink netting, the most prominent disadvantage is the need for an oven-like apparatus or gun-like apparatus for heating the net to cause it to heat shrink. These apparati are quite costly to use due to energy consumption. In addition, it is difficult to obtain uniform tension on the load using this method.

The applicants have now discovered a plastic net material for load unitization which avoids the problems experienced in the prior art. In accordance with the applicants invention a netting material is used which is biaxially oriented to a sufficient degree so that it will stretch no more than about 15%, and preferably no more than 10%, under loads commonly encountered on pallets, even at high temperatures. In particular, the biaxially oriented netting material should withstand a load of at least 20 pounds pulling on a 3-inch strip of the net at temperatures as high as 180° F.

The netting to be used in the present invention is formed by an extrusion process such as that disclosed in U.S. Pat. Nos. 3,252,181, 3,384,692, 3,700,521 and the like. These nets are well known in the art. After extrusion the nets are biaxially oriented, preferably in accordance with the teaching of U.S. Pat. No. 4,152,479. In accordance with the present invention, the net is biaxially oriented to a sufficient degree that it stretches no more than about 15% when subjected to normal palletized load stresses at temperatures as high as 180° F.

The preferred net for use in the present invention is an extruded polypropylene net formed according to U.S. Pat. No. 3,384,692 and having approximately 7 strands per inch in the machine direction and 5 strands per inch in the transverse direction. This net is biaxially oriented according to U.S. Pat. No. 4,152,479, after which it has approximately 1½ strands per inch in the machine direction and 1⅓ strands per inch in the transverse direction, i.e. 3 strands per 2 inches in the machine direction and 4 strands per 3 inches in the transverse direction. The weight of the biaxially oriented material is approximately 3 pounds per thousand square feet.

Nets according to the present invention have been used on a wide variety of palletized loads by wrapping the netting about the load on the pallet. It has been found that the nets according to the present invention are markedly superior to nets available in the prior art for pallet load wrapping.

It will be understood that the claims are intended to cover all changes and modifications of the preferred embodiments of the invention, herein chosen for the purpose of illustration, which do not constitute departures from the spirit and scope of the invention. It will also be understood that the pertinent portion of all United States patents mentioned are incorporated herein by reference.

What is claimed is:

1. In the wrapping of palletized loads with netting material, the improvement ccomprising said netting material being biaxially oriented to a sufficient degree to stretch less than about 15% when subjected to normal palletized load stresses at temperatures up to about 180° F.

2. The palletized load of claim 1 wherein said stretcch is no greater than about 10%.

3. The palletized load of claim 1 wherein said netting material is of polypropylene, has about 1½ strands per inch in one direction and about 1⅓ strands per inch in a second direction and weighs about 3 pounds per thousand square feet.

* * * * *